US011773584B1

(12) United States Patent
Kerschner

(10) Patent No.: US 11,773,584 B1
(45) Date of Patent: Oct. 3, 2023

(54) UNIVERSAL SEAT PLATE MOUNTING BRACKETS

(71) Applicant: Gordy Kerschner, Wyoming, MN (US)

(72) Inventor: Gordy Kerschner, Wyoming, MN (US)

(73) Assignee: FIREBALL FAB AND METAL SALES, LLC, Wyoming, MN (US)

( * ) Notice: Subject to any disclaimer, the term of this patent is extended or adjusted under 35 U.S.C. 154(b) by 176 days.

(21) Appl. No.: 17/379,274

(22) Filed: Jul. 19, 2021

Related U.S. Application Data

(60) Provisional application No. 63/054,456, filed on Jul. 21, 2020.

(51) Int. Cl.
*E04B 1/58* (2006.01)
*E04B 1/38* (2006.01)

(52) U.S. Cl.
CPC ..... *E04B 1/388* (2023.08); *E04B 1/58* (2013.01); *E04B 2001/389* (2023.08)

(58) Field of Classification Search
CPC . E04B 1/40; E04B 1/58; E04B 1/2403; E04B 1/2439; E04B 2001/405; E04B 2001/2415
USPC ..... 248/247
See application file for complete search history.

(56) References Cited

U.S. PATENT DOCUMENTS 5,146,724 A * 9/1992 Angelo ..... F16B 2/02 403/387
8,511,929 B2 * 8/2013 Raye ..... F16B 2/02 52/39
8,973,333 B2 * 3/2015 Sugihara ..... E04B 1/40 52/712
9,920,531 B1 * 3/2018 Charest ..... E04B 1/2604
10,072,412 B2 * 9/2018 Brekke ..... E04B 1/2612
2014/0130441 A1 * 5/2014 Sugihara ..... E04B 1/2403 52/656.9
2015/0308098 A1 * 10/2015 Tessadori ..... E04B 2/7411 52/698
2015/0345137 A1 * 12/2015 Loyd ..... E04F 13/25 52/745.11
2016/0186424 A1 * 6/2016 Meyer ..... E04B 1/24 52/702
2017/0204600 A1 * 7/2017 Daudet ..... E04B 1/40
2018/0044910 A1 * 2/2018 Lastowski ..... E04B 2/821
2019/0136512 A1 * 5/2019 Naylor ..... E04B 2/721
2019/0285224 A1 * 9/2019 McKechnie ..... E04B 9/20
2022/0025637 A1 * 1/2022 Stahl ..... E04B 1/2403

* cited by examiner

*Primary Examiner* — Nkeisha Smith
(74) *Attorney, Agent, or Firm* — SHERRILL LAW OFFICES, PLLC

(57) ABSTRACT

A universal seat plate mounting bracket assembly that includes a mounting bracket having a back plate and a knife plate, and a seat pad. The back plate has transversely z spaced first and second major surfaces. The knife plate has laterally y spaced first and second major surfaces and a proximal transverse z end affixed to the first major surface of the back plate. The seat pad is configured and arranged for repositionable fixed attachment atop the upper longitudinal x edge of the knife plate at one of a plurality of selective transverse z distances from the back plate. The seat pad includes a seat plate with first and second major surfaces longitudinally x spaced from one another when the seat pad is attached atop the upper edge of the knife plate.

25 Claims, 7 Drawing Sheets

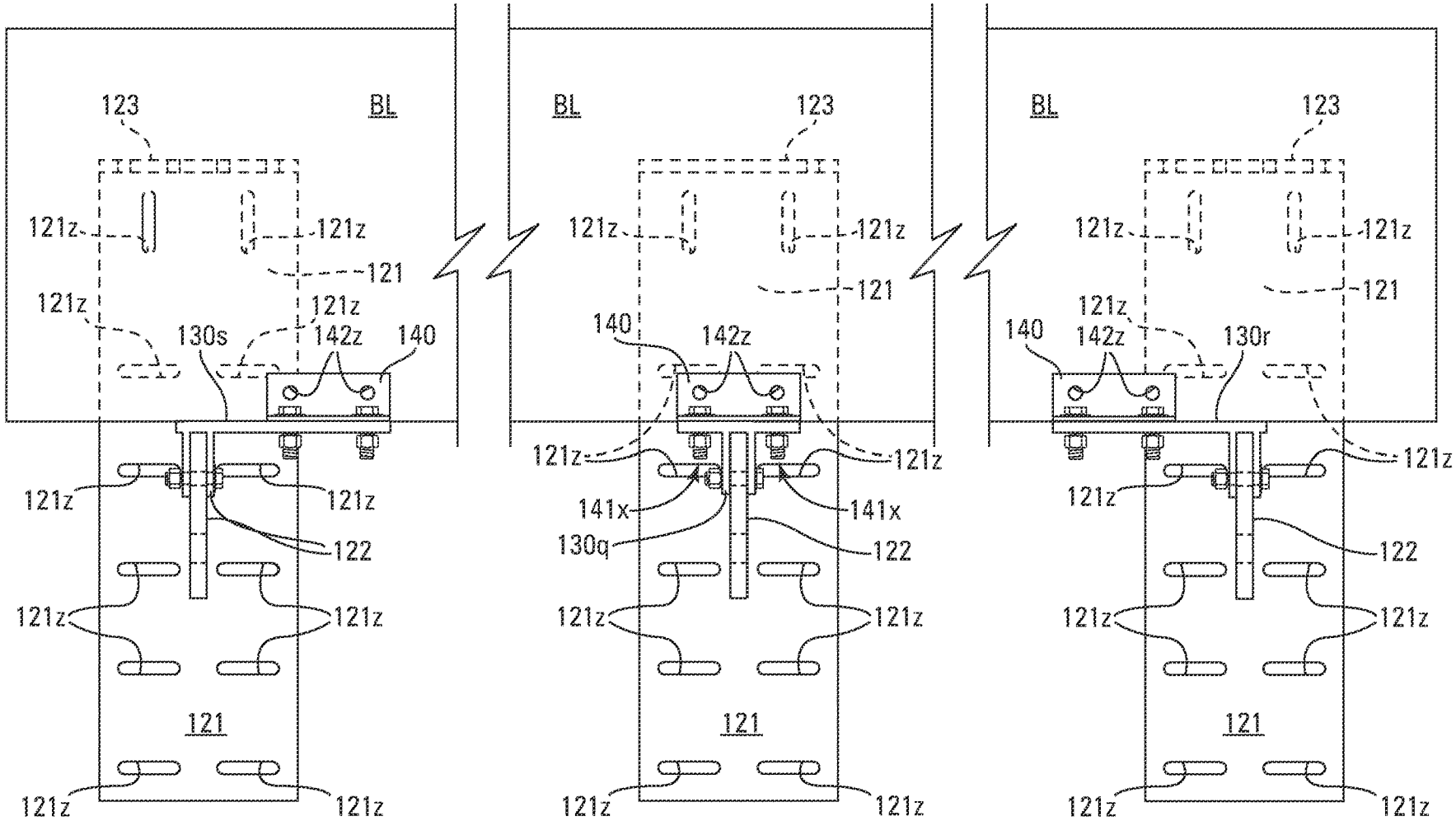
BL
123
121z
121
121z
122
121z
121z
121z

UNIVERSAL SEAT PLATE MOUNTING BRACKETS

BACKGROUND

Seat plate mounting brackets are used to support a horizontal joist on the face of a vertical wall.

Seat plate mounting brackets are commonly used to support the header joist of a balcony floor to the exterior of a vertical wall. When seat plate mounting brackets are used for this purpose the seat plate mounting brackets cannot be acquired until the thickness of the exterior wall cladding is known as the seat plate mounting brackets must be attached directly to the wall studs and therefore must accommodate not only the thickness of the balcony floor header joist but the thickness of the exterior cladding between the face of the mounting plate and the face of the seat clip on the seat plate. This can result in construction delays when the desired number of properly dimensioned seat plate mounting brackets are not in stock and must be ordered from a remote location.

Hence, a need exists for a universal seat plate mounting bracket capable of accommodating significant changes in the thickness of the exterior cladding on a structure so that the seat plate mounting bracket may be pre-ordered and available on-site for immediate use when construction of the balcony commences.

SUMMARY OF THE INVENTION

A first aspect of the invention is a universal seat plate mounting bracket assembly.

In a first embodiment the seat plate mounting bracket assembly includes a mounting bracket with a back plate and a knife plate, and a seat pad.

The back plate has longitudinally x spaced upper and lower ends, laterally y spaced right and left sides, and transversely z spaced first and second major surfaces. The knife plate has longitudinally x spaced upper and lower edges, laterally y spaced first and second major surfaces, and transversely z spaced proximate and distal ends. The proximal end of the knife plate is affixed to the first major surface of the back plate.

The seat pad is configured and arranged for repositionable fixed attachment atop the upper edge of the knife plate at one of a plurality of selective transverse z distances from the back plate. The seat pad includes a seat plate with first and second major surfaces. The first and second major surfaces of the seat plate are longitudinally x spaced from one another when the seat pad is attached atop the upper edge of the knife plate.

In a second embodiment the seat plate mounting bracket assembly includes a mounting bracket with a back plate, knife plate and bracket tab, and a seat pad.

The back plate extends within a frontal x-y plane and has an upper longitudinal x end and a lower longitudinal x end. The knife plate is affixed to and extends in a longitudinal x-z plane from the back plate in a first transverse z direction. The knife plate has a longitudinal x upper edge. The bracket tab is affixed to and extends in a transverse y-z plane from proximate the upper longitudinal x end of the back plate in a second transverse z direction opposite the first transverse z direction.

The seat pad is configured and arranged for repositionable fixed attachment atop the upper edge of the knife plate at one of a plurality of selective transverse z distances from the back plate. The seat pad includes a seat plate extending within a transverse y-z plane and extending laterally y from the knife plate.

A second aspect of the invention is a kit of components from which universal seat plate mounting bracket assemblies in accordance with the first aspect of the invention may be assembled. The kit includes the separate and independent components of mounting brackets, seat pads, and optionally seat clip angle brackets.

The seat pads include at least one each of a right seat pad, a left seat pad and a center seat pad. The right seat pad has a seat plate that extends a lateral y distance in a first lateral y direction from the knife plate when secured atop the upper longitudinal x edge of the knife plate. The left seat pad has a seat plate that extends a lateral y distance in a second lateral y direction diametrically opposed to the first lateral y direction from the knife plate when secured atop the upper longitudinal x edge of the knife plate. The center seat pad has a seat plate that extends an equal lateral y distance of at least 1 inch in both the first and second lateral y directions from the knife plate when secured atop the upper longitudinal x edge of the knife plate.

A third aspect of the invention is a method of using the universal seat plate mounting bracket assemblies according to the first aspect of the invention to secure a laterally y extending header joist to a vertical structure having a frame formed of wall framing members.

A plurality of horizontally aligned mounting brackets are fastened to the wall framing members of the vertical structure with the back plate extending vertically and the bracket tab extending horizontally. The seat plate of each universal seat plate mounting bracket assembly is positioned along the transverse z depth of the knife plate underneath the anticipated location of the header joist on the vertical structure and secured to the knife plate at that position.

The header joist is rested upon the seat plate of each positioned seat pad, and then fastened to the vertical structure.

When the seat plate mounting bracket assembly includes a seat clip angle bracket, the final steps are positioning the seat clip angle bracket into abutting engagement with the header joist, fastening the abutting seat clip angle bracket to the seat plate at that position, and fastening the seat clip angle bracket to the abutting header joist.

BRIEF DESCRIPTION OF THE DRAWINGS

FIG. 9 is a front view of a plurality of horizontally aligned mounting brackets supporting a header joist.

DETAILED DESCRIPTION OF THE INVENTION

Including a Preferred Embodiment

Nomenclature Table

Figure 1:
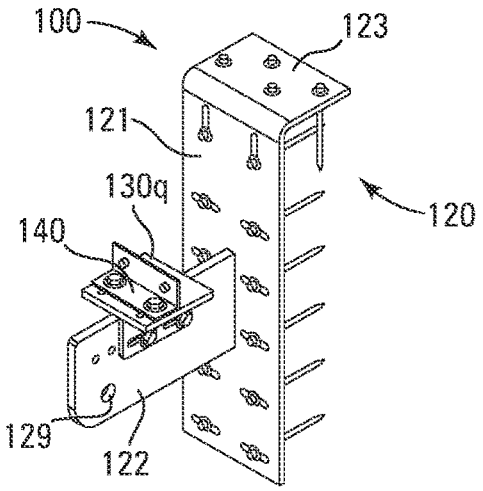
FIG. 1 is a perspective view of one embodiment of the invention with a centered seat pad.

| REF. NO. | DESCRIPTION |
|---|---|
| 100 | Seat Plate Mounting Bracket Assembly |
| 120 | Mounting Bracket |
| 121 | Back Plate |
| $121x^1$ | Upper Longitudinal End of Back Plate |
| $121x^2$ | Lower Longitudinal End of Back Plate |
| $121y^1$ | Right Lateral Side of Back Plate |
| $121y^2$ | Left Lateral Side of Back Plate |
| $121z^1$ | First Major Transverse Surface of Back Plate |
| $121z^2$ | Second Major Transverse Surface of Back Plate |
| 121z | Transverse Screw Holes Through Back Plate |
| 122 | Knife Plate Extending in First Transverse Direction from Back Plate |
| $122x^1$ | Longitudinal Upper Edge of Knife Plate |
| $122x^2$ | Longitudinal Lower Edge of Knife Plate |
| 122y | Lateral Bolt Holes Through Knife Plate |
| $122y^1$ | Lateral First Major Surface of Knife Plate |
| $122y^2$ | Lateral Second Major Surface of Knife Plate |
| $122z^1$ | Transverse Proximal End of Knife Plate |
| $122z^2$ | Transverse Distal End of Knife Plate |
| 123 | Bracket Tab Extending in Second Transverse Direction from Back Plate |
| 123x | Longitudinal Screw Holes Through Bracket Tab |
| 129 | Tie-Rod Connection Orifice |
| 130 | Seat Pad |
| 130q | Centered Seat Pad |
| 130r | Right Seat Pad |
| 130s | Left Seat Pad |
| 131 | Seat Plate |
| 131x | Longitudinal Bolt Holes Through Seat Plate |
| $131x^1$ | Longitudinal First Major Surface of Seat Plate |
| $131x^2$ | Longitudinal Second Major Surface of Seat Plate |
| 133 | Seat Tab Extending in First Longitudinal Direction from Seat Pad |

-continued

Nomenclature Table

| REF. NO. | DESCRIPTION |
|---|---|
| 133y | Lateral Bolt Holes Through Seat Tab |
| 140 | Seat Clip Angle Bracket |
| 141 | Horizontal Leg of Seat Clip Angle Bracket |
| 141x | Longitudinal Bolt Holes Through Horizontal Leg |
| 142 | Vertical Leg of Seat Clip Angle Bracket |
| 142z | Transverse Screw Holes Through Vertical Leg |
| x | Longitudinal Axis |
| y | Lateral Axis |
| z | Transverse Axis |
| BJ | Balcony Joist |
| BL | Balcony Header joist |
| WH | Wall Header |
| WS | Wall Stud |

Construction

Referring to FIGS. 1, 2, 3, 4, 4A and 4B, the universal seat plate mounting bracket assembly 100 includes at least a mounting bracket 120 and a repositionable seat pad 130.

Referring to FIGS. 5 and 5A-C, the mounting bracket 120 has a back plate 121 and a knife plate 122.

The back plate 120 has longitudinally x spaced upper and lower ends $\mathbf{121}x^1$ and $\mathbf{121}x^2$, laterally y spaced right and left sides $\mathbf{121}y^1$ and $\mathbf{121}y^2$, and transversely z spaced first and second major surfaces $\mathbf{121}z^1$ and $\mathbf{121}z^2$.

The knife plate 122 has longitudinally x spaced upper and lower edges $\mathbf{122}x^1$ and $\mathbf{122}x^2$, laterally y spaced first and second major surfaces $\mathbf{122}y^1$ and $\mathbf{122}y^2$, and transversely z spaced proximate and distal ends $\mathbf{122}z^1$ and $\mathbf{122}z^2$ with the proximal end $\mathbf{122}z^1$ projecting from and affixed to the first major surface $\mathbf{121}z^1$ of the back plate 121.

Referring to FIGS. 6, 6A-C, 7, 7A-C and 8 and 8A-C, the seat pad 130 includes a seat plate 131 and a means for fixedly attaching the seat pad 130 atop the upper edge $\mathbf{122}x^1$ of the knife plate 122 at one of a plurality of selective transverse z distances from the back plate 121. The seat plate 131 has first and second major surfaces $\mathbf{131}x^1$ and $\mathbf{131}x^2$ which are longitudinally x spaced from one another when the seat pad 130 is attached atop the upper edge $\mathbf{122}x^1$ of the knife plate 122.

Referring to FIGS. 1, 2, 3, 4, 4A and 4B, in a preferred embodiment the universal seat plate mounting bracket assembly 100 includes a mounting bracket 120 with a back plate 121, a knife plate 122 and a bracket tab 123, a repositionable seat pad 130, and optionally but preferably a seat clip angle bracket 140.

Referring to FIGS. 5, 5A, 5B and 5C, in the preferred embodiment the mounting bracket 120 has a back plate 121, a knife plate 122 and a bracket tab 123. The back plate 121 extends within a frontal x-y plane with an upper longitudinal x end $\mathbf{121}x^1$ and a lower longitudinal x end $\mathbf{121}x^2$. The knife plate 122 is affixed to and extends in a longitudinal x-z plane from the back plate 121 in a first transverse z direction. The knife plate 122 has a longitudinal x upper edge $\mathbf{122}x^1$. The bracket tab 123 is affixed to and extends in a transverse y-z plane from proximate the upper longitudinal x end $\mathbf{121}x^1$ of the back plate 121 in a second transverse z direction opposite the first transverse z direction.

Figure 4:
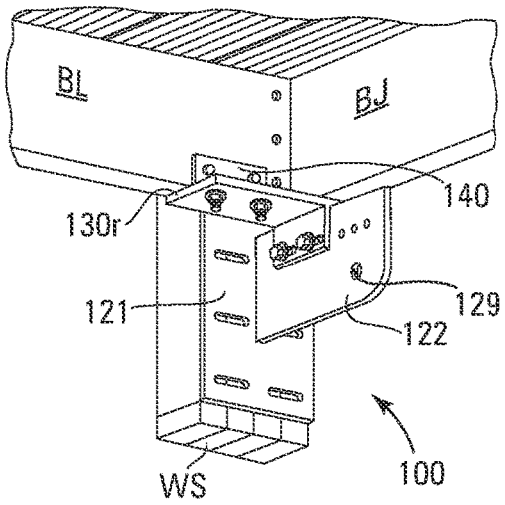
FIG. 4 is a perspective view of the invention depicted in FIG. 2 bolted to a set of wall studs and supporting a balcony subfloor ledger and end joist.
Figure 4A:
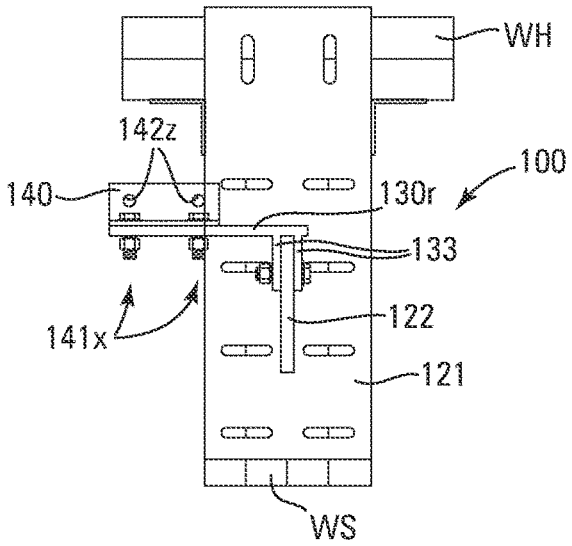
FIG. 4A is a front view of the invention depicted in FIG. 4 sans balcony subfloor ledger and end joist.
Figure 4B:
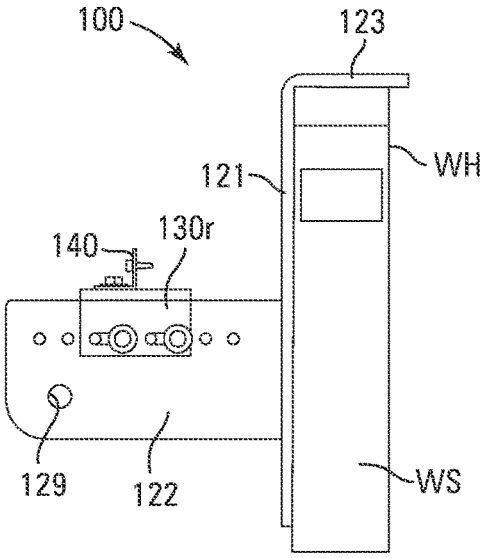
FIG. 4B is a side view of the invention depicted in FIG. 4 sans balcony subfloor ledger and end joist.
Figure 5C:
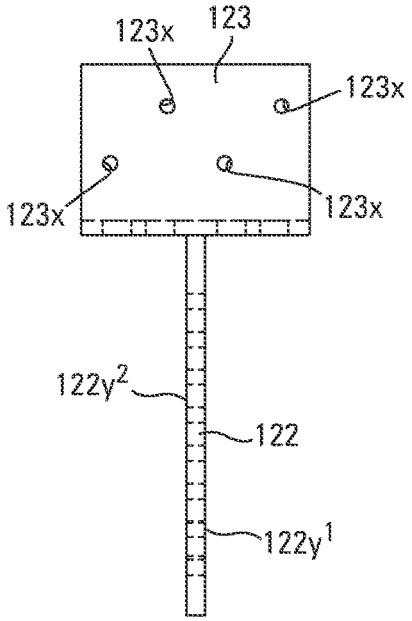
FIG. 5C is a top view of the mounting bracket component depicted in FIG. 5.
Figure 5:
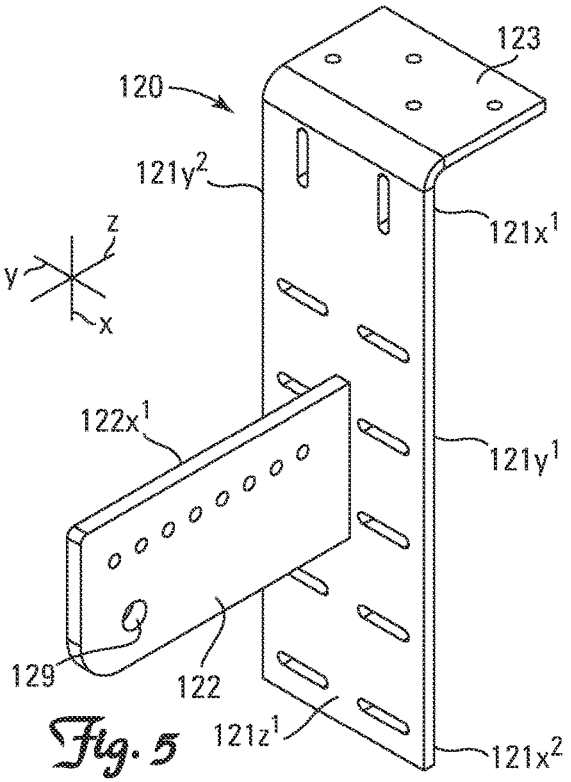
FIG. 5 is a perspective view of the mounting bracket component of the invention depicted in FIGS. 1, 2 and 3.
Figure 5A:
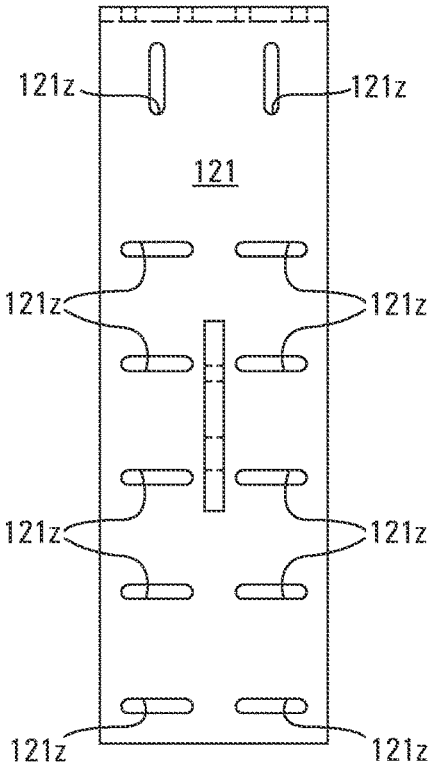
FIG. 5A is a front view of the mounting bracket component depicted in FIG. 5.

Referring to FIGS. 5 and 5A, a plurality of orifices 121z extend transversely z through the back plate 121 for accommodating passage of a fastener, such as a nail or screw, for securing the universal seat plate mounting bracket 100 to a wall framing member WH and WS as depicted in FIGS. 4, 4A and 4B.

Referring to FIGS. 5 and 5C, a plurality of orifices 123*x* also extend longitudinally x through the bracket tab 123, for accommodating passage of a fastener, such as a nail or screw, for securing the universal seat plate mounting bracket 100 to a wall framing member WH or WS as depicted in FIGS. 4, 4A and 4B.

An orifice 129 extends laterally y through the knife plate 122 for use in connecting one end of a tie rod (not shown) to the universal seat plate mounting bracket assembly 100.

Figure 2:
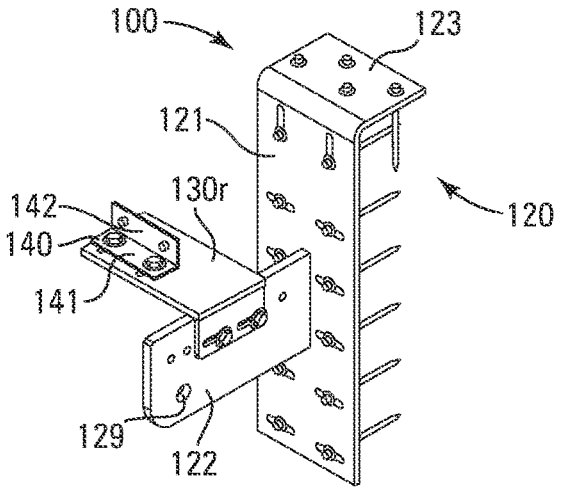
FIG. 2 is a perspective view of one embodiment of the invention with a right extending seat pad.
Figure 3:
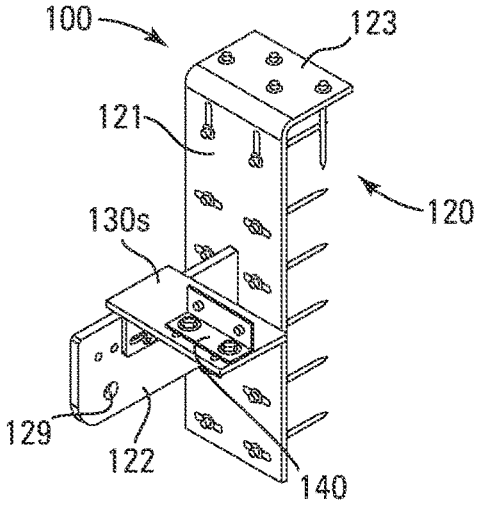
FIG. 3 is a perspective view of one embodiment of the invention with a left extending seat pad.

Referring to FIGS. 1, 2 and 3, the seat pad 130 is configured and arranged for securement atop the longitudinal x upper edge 122$x^1$ of the knife plate 122 at any of a plurality of selective transverse z distances from the back plate 121. The seat pad 130 has a seat plate 131 that, when the seat pad 130 is affixed atop the longitudinal x upper edge 122$x^1$ of the knife plate 122, extends within a transverse y-z plane and extends laterally y from the knife plate 122.

Figure 5B:
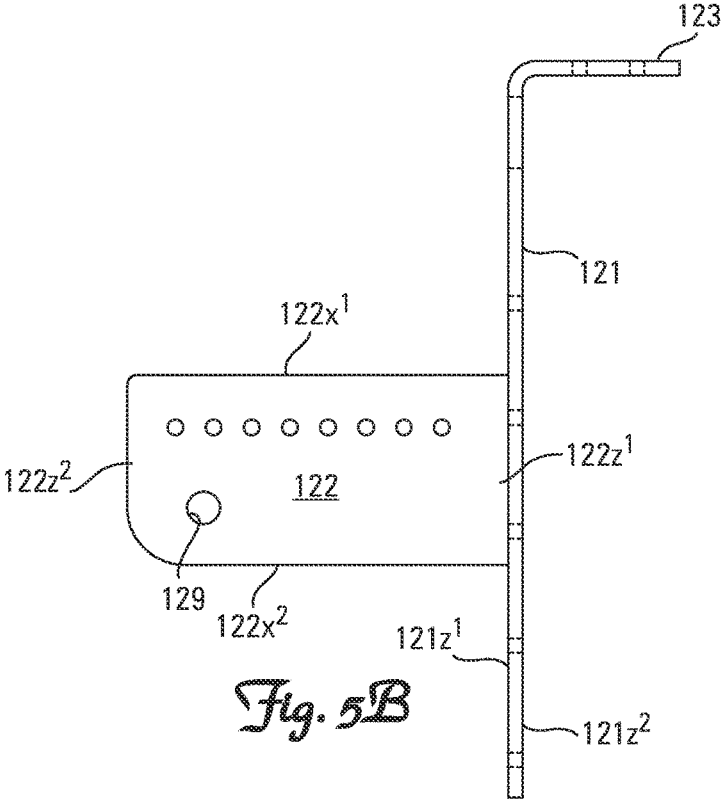
FIG. 5B is a side view of the mounting bracket component depicted in FIG. 5.
Figure 6:
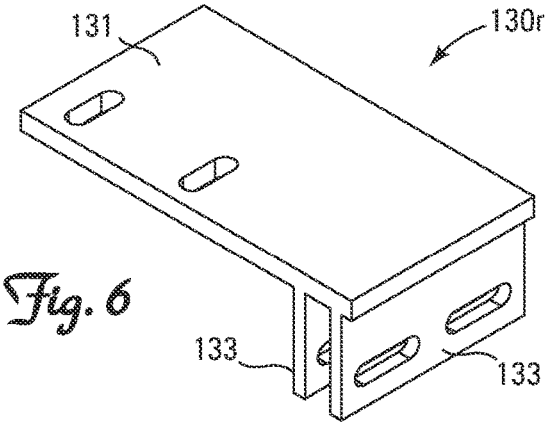
FIG. 6 is a perspective view of the right seat pad component of the invention depicted in FIG. 2.
Figure 6C:
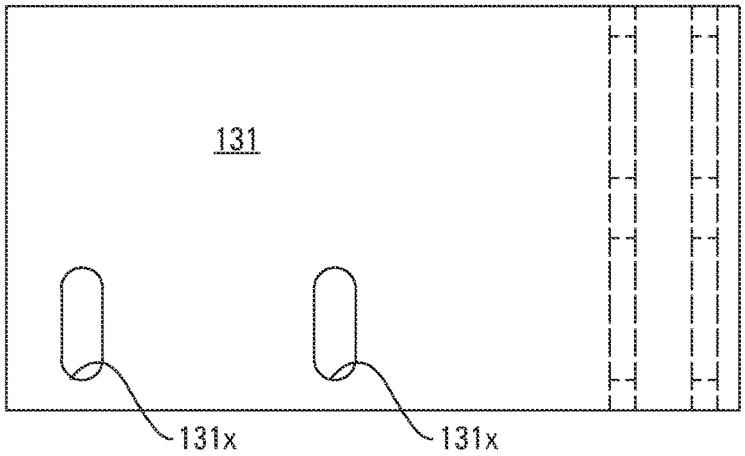
FIG. 6C is a top view of the right seat pad component of the invention depicted in FIG. 6.
Figure 6A:
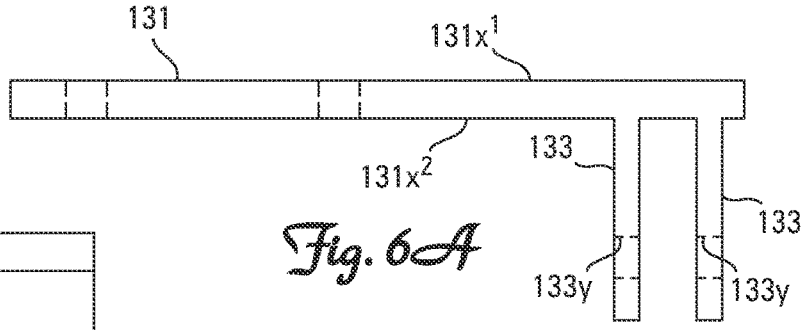
FIG. 6A is a front view of the right seat pad component of the invention depicted in FIG. 6.
Figure 6B:
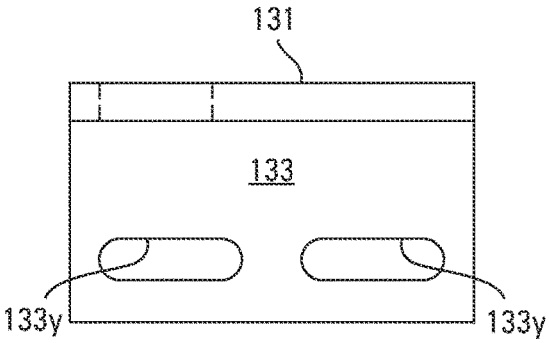
FIG. 6B is a side view of the right seat pad component of the invention depicted in FIG. 6.
Figure 7:
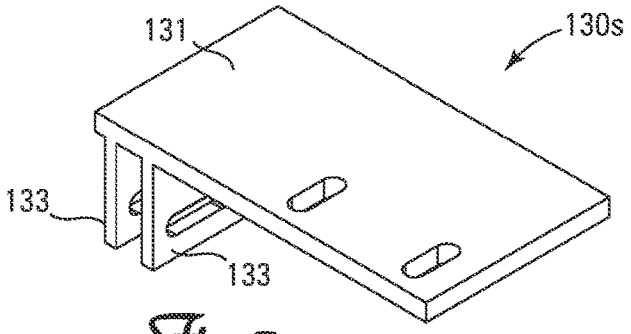
FIG. 7 is a perspective view of the left seat pad component of the invention depicted in FIG. 3.
Figure 7C:
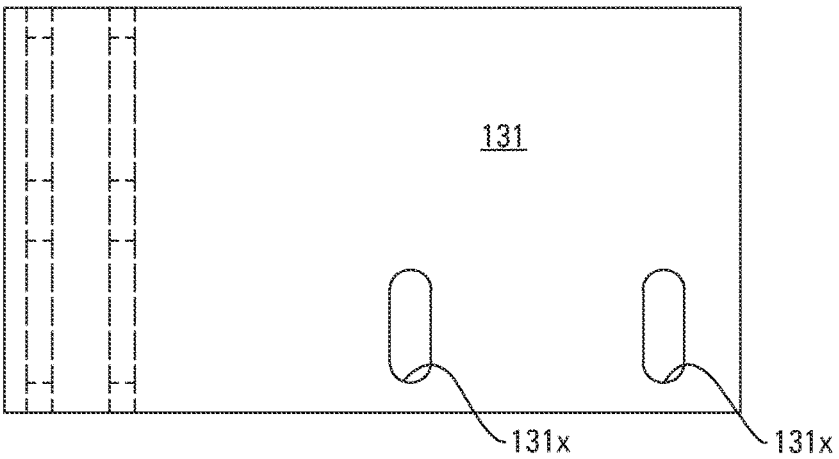
FIG. 7C is a top view of the left seat pad component of the invention depicted in FIG. 7.
Figure 7A:
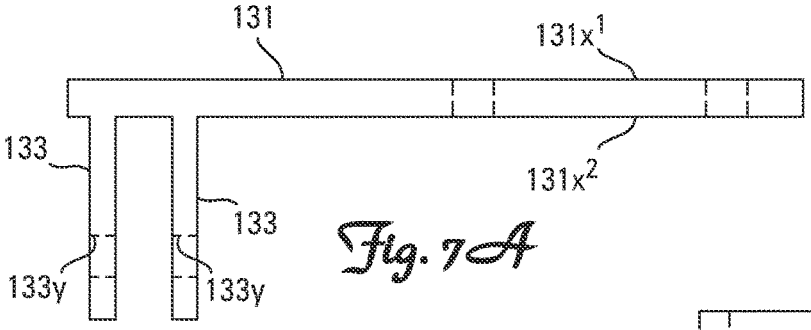
FIG. 7A is a front view of the left seat pad component of the invention depicted in FIG. 7.
Figure 7B:
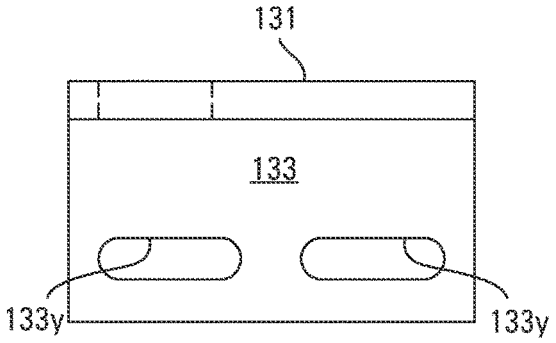
FIG. 7B is a side view of the left seat pad component of the invention depicted in FIG. 7.
Figure 8C:
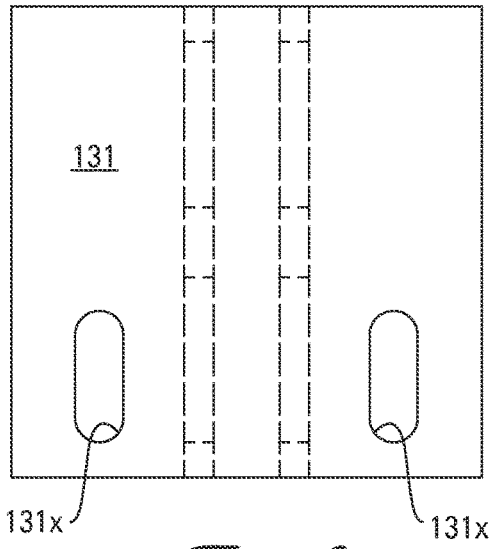
FIG. 8C is a top view of the centered seat pad component of the invention depicted in FIG. 8.
Figure 8:
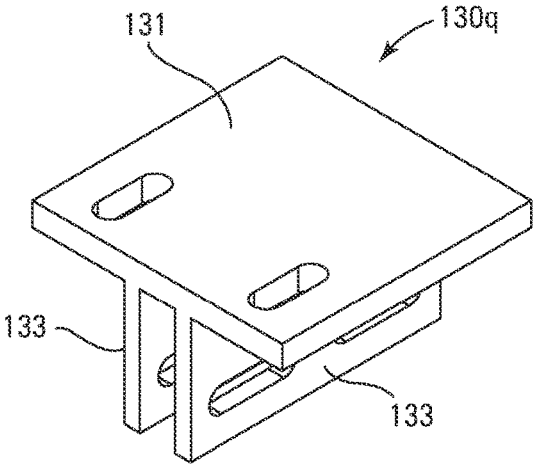
FIG. 8 is a perspective view of the centered seat pad component of the invention depicted in FIG. 1.
Figure 8A:
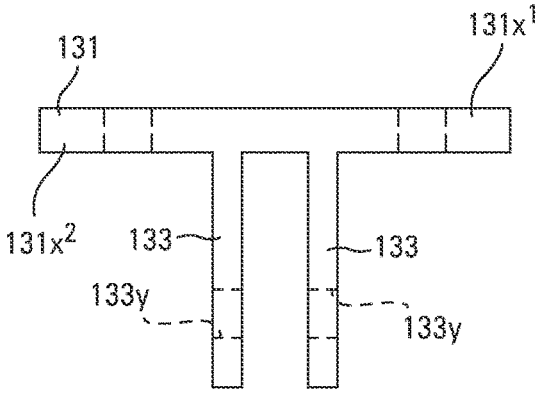
FIG. 8A is a front view of the centered seat pad component of the invention depicted in FIG. 8.
Figure 8B:
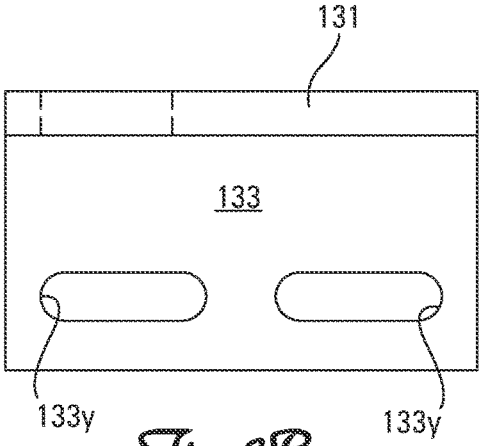
FIG. 8B is a side view of the centered seat pad component of the invention depicted in FIG. 8.

Referring to FIGS. 6, 6A-C, 7, 7A-C and 8 and 8A-C, in a preferred embodiment the seat pad 130 includes a pair of laterally y spaced seat tabs 133 extending longitudinally x downward from the seat plate 131 for use in securing the seat pad 130 to the knife plate 122. The seat tabs 133 define a gap (unnumbered) therebetween for fitted engagement of an upper margin of the knife plate 122 within the gap as depicted in FIGS. 4, 4A and 4B. Referring to FIGS. 5 and 5B, a series of transversely z spaced orifices 122*y* extend laterally y through the knife plate 122. Referring to FIGS. 6, 6A-C, 7, 7A-C and 8 and 8A-C, a plurality of transversely z spaced orifices 133*y* extend laterally y through each of the seat tabs 133. The orifices 133*y* in the seat tabs 133 are laterally y aligned in pairs.

Referring to FIGS. 1-3, the seat pad 130 can be selected from three different seat pads 130, each with a different lateral y extension of the seat plate 131 relative to the seat tabs 133. A center seat pad 130*q* (FIG. 1) has a seat plate 131 that extends equal lateral distances of at least 1 inch in both the first and second lateral y directions from the seat tabs 133 and the knife plate 122 positioned therebetween. A right seat pad 130*r* (FIG. 2) has a seat plate 131 that extends a lateral y distance of between 2 and 6 inches in a first lateral y direction from the seat tabs 133 and the knife plate 122 positioned therebetween. A left seat pad 130*s* (FIG. 3) has a seat plate 131 that extends a lateral y distance of between 2 and 6 inches in a second lateral y direction from the seat tabs 133 and the knife plate 122 positioned therebetween.

Referring to FIGS. 1, 2, 3, 4 and 4B, the orifices 122*y* through the knife plate 122 and the orifices 133*y* through the seat tabs 133 are configured and arranged for selective lateral y alignment with one another at a plurality of different positions along the transverse z depth of the knife plate 122 to form a through hole for accommodating passage of a fastener, such as a bolt (unnumbered), therethrough to secure the seat pad 130 to the knife plate 122 at a selective transverse z distance from the back plate 121.

Referring to FIGS. 6, 6B, 7, 7B, 8 and 8B, the orifices 133*y* through the seat tabs 133 can be transversely z elongated slots to accommodate fine tuning of the transverse z positioning of the seat pad 130 relative to the back plate 121.

Referring to FIGS. 1, 2 and 3, the seat clip angle bracket 140 is configured and arranged for securement atop the seat plate 131, with a horizontal leg 141 resting against the seat plate 131 and a vertical leg 142 extending within a frontal x-y plane and upward in longitudinal x direction from the seat plate 131.

Referring to FIGS. 6, 6C, 7, 7C, 8 and 8C, a plurality of laterally y spaced orifices 131*x* extending longitudinally x through the seat plate 131. Referring to FIGS. 1, 2, 3 and 4A, a plurality of laterally y spaced orifices 141*x* extend longitudinally x through the horizontal leg 141 of the seat clip angle bracket 140. The orifices 131*x* through the seat plate 131 and the orifices 141*x* through the horizontal leg 141 of the seat clip angle bracket 140 correspond with one another for longitudinal x alignment to form through holes for accommodating passage of fasteners such as bolts (unnumbered), therethrough to secure the seat clip angle bracket 140 to the seat plate 131.

Referring to FIGS. 6, 6C, 7, 7C, 8 and 8C, the orifices 131*x* through the seat plate 131 and/or the orifices 141*x* through the horizontal leg 141 of the seat clip angle bracket 140 can be transversely z elongated slots to accommodate fine tuning of the transverse z positioning of the seat clip angle bracket 140 on the seat plate 131 and relative to the back plate 121.

A plurality of laterally y spaced orifices 142*z* extending transversely z through the vertical leg 142 of the seat clip angle bracket 140 for accommodating passage of fasteners, such as a nail or screw, therethrough for securing the seat clip angle bracket 140 to a header joist BL.

The entire universal seat plate mounting bracket assembly 100 is preferably formed of metal, with the back plate 121 and the bracket tab 123 formed from a unitary solid piece of metal.

The back plate 121 preferably has a longitudinal x height of 4 to 12 inches and a lateral y width of 2 to 6 inches. The knife plate 122 preferably has a transverse z depth of 4 to 12 inches and a longitudinal x height of 2 to 6 inches. The bracket tab 123 preferably has a transverse z depth of 2 to 6 inches and a lateral y width of 2 to 6 inches. The seat plate 131 preferably has a transverse z depth of 1 to 6 inches and a lateral y width of 2 to 6 inches.

The universal seat plate mounting bracket assemblies 100 can be provided as a kit, allowing on-site assembly of the desired number of each of the seat plate mounting bracket assemblies 100 with a center seat pad 130*q*, a right seat pad 130*r*, and a left seat pad 130*s*.

The kit would include a plurality of the mounting brackets 120 and at least one of each, preferably a plurality of each, of a center seat pad 130*q*, a right seat pad 130*r*, and a left seat pad 130*s*. The kit would preferably also include a plurality of seat clip angle brackets 140, typically one for each mounting bracket 120 in the kit.

Use

The universal seat plate mounting bracket assemblies 100 are used to secure a laterally y extending header joist such as a balcony ledger BL to a vertical structure having a frame formed of wall framing members WH, WS.

A plurality of horizontally aligned mounting brackets 120 are fastened to the wall framing members WH, WS of the vertical structure with the back plate 121 extending vertically and the bracket tab 123 extending horizontally. The seat plate 131 of each universal seat plate mounting bracket assembly 100 is then positioned along the transverse z depth of the knife plate 122 underneath the anticipated location of the balcony ledger BL on the vertical structure and secured to the knife plate 122 at that position. Alternatively, once the proper transverse z position of the seat pad 130 on the knife plate 122 is determined the seat pad 130 can be secured to the knife plate 122 at that position prior to fastening the mounting bracket 120 to the wall framing members WH, WS, but this sequence is generally less preferred as the seat pad 130 tends to interfere with the driving of fasteners through some of the orifices 121*z* in the back plate 121 of the mounting bracket 120 to secure the mounting bracket 120 to the wall framing members WH, WS.

A right seat pad 130*r* should be affixed to the mounting bracket 120 at one end of the horizontal line of mounting brackets 120 with the seat plate 131 extending laterally y towards the other mounting brackets 120 fastened to the vertical wall structure, and a left seat pad 130*s* should be affixed to the mounting bracket 120 at the other end of the horizontal line of mounting brackets 120 with the seat plate 131 extending laterally y towards the other mounting brackets 120 fastened to the vertical wall structure. A center seat pad 130*q* should be affixed to the balance of the mounting brackets 120.

To complete the process, rest the balcony ledger BL upon the seat plate 131 of each positioned seat pad 130, and fasten the resting balcony ledger BL to the vertical structure.

When the seat plate mounting bracket assembly 100 includes a seat clip angle bracket 140, the final steps are positioning the seat clip angle bracket 140 into abutting engagement with the balcony ledger BL, fastening the abutting seat clip angle bracket 140 to the seat plate 131 at that position, and fastening the seat clip angle bracket 140 to the abutting balcony ledger BL.

Referring to FIGS. 5 and 5A-C, the mounting bracket 120 has a back plate 121 and a knife plate 122.

I claim:

1. A universal seat plate mounting bracket assembly, comprising:

(a) a mounting bracket having:

(i) a back plate having longitudinally (x) spaced upper and lower ends, laterally (y) spaced right and left sides, and transversely (z) spaced first and second major surfaces, and (ii) a knife plate having longitudinally (x) spaced upper and lower edges, laterally (y) spaced first and second major surfaces, and transversely (z) spaced proximate and distal ends with the proximal end affixed to the first major surface of the back plate, and (b) a seat pad with a seat plate having first and second major surfaces, the seat pad configured and arranged for repositionable fixed attachment atop the upper edge of the knife plate at one of a plurality of selective transverse (z) distances from the back plate, wherein the first and second major surfaces of the seat plate are longitudinally (x) spaced from one another when the seat pad is attached atop the upper edge of the knife plate.

2. A universal seat plate mounting bracket assembly, comprising:

(a) a mounting bracket having (i) a back plate extending within a frontal (x-y) plane and having an upper longitudinal (x) end and a lower longitudinal (x) end, (ii) a knife plate affixed to and extending in a longitudinal (x-z) plane from the back plate in a first transverse (z) direction and having a longitudinal (x) upper edge, and (iii) a bracket tab affixed to and extending in a transverse (y-z) plane from proximate the upper longitudinal (x) end of the back plate in a second transverse (z) direction opposite the first transverse (z) direction, and (b) a seat pad repositionably secured atop the longitudinal (x) upper edge of the knife plate at one of a plurality of selective transverse (z) distances from the back plate, the seat pad having a seat plate extending within a transverse (y-z) plane and extending laterally (y) from the knife plate.

3. The universal seat plate mounting bracket assembly of claim 2, further comprising a seat clip angle bracket secured atop the seat plate, the seat clip angle bracket having a horizontal leg resting against the seat plate and a vertical leg that extends within a frontal (x-y) plane and extends in an upward longitudinal (x) direction from the seat plate.

4. The universal seat plate mounting bracket assembly of claim 2 wherein an entire universal seat plate mounting bracket is metal, and the back plate and the bracket tab are formed from a unitary solid piece of metal.

5. The universal seat plate mounting bracket assembly of claim 2 further comprising a plurality of orifices extending transversely (z) through the back plate, each orifice configured for accommodating passage of a fastener for securing the universal seat plate mounting bracket to a wall framing member.

6. The universal seat plate mounting bracket assembly of claim 5 further comprising a plurality of orifices extending longitudinally (x) through the bracket tab, each orifice configured for accommodating passage of a fastener for securing the universal seat plate mounting bracket to a wall framing member.

7. The universal seat plate mounting bracket assembly of claim 2 wherein the seat pad further comprises laterally (y) spaced seat tabs extending longitudinally (x) downward from the seat plate so as to define a gap therebetween configured and arranged for fitted engagement of an upper margin of the knife plate within the gap.

8. The universal seat plate mounting bracket assembly of claim 7 further comprising (i) a series of transversely (z) spaced orifices extending laterally (y) through the knife plate, and (ii) a plurality of transversely (z) spaced orifices extending laterally (y) through each of the seat tabs, with the orifices in the seat tabs laterally (y) aligned in pairs, wherein the orifices through the knife plate and the orifices through the seat tabs are configured and arranged for selective lateral (y) alignment to form a through hole for accommodating passage of a fastener therethrough for securing the seat pad to the knife plate at selective transverse (z) distances from the back plate.

9. The universal seat plate mounting bracket assembly of claim 8 wherein the orifices through the seat tabs are transversely (z) elongated slots.

10. The universal seat plate mounting bracket assembly of claim 2 wherein the back plate has a longitudinal (x) height of 4 to 12 inches and a lateral (y) width of 2 to 6 inches, and the bracket tab has a transverse (z) depth of 2 to 6 inches and a lateral (y) width of 2 to 6 inches.

11. The universal seat plate mounting bracket assembly of claim 2 wherein the knife plate has a transverse (z) depth of 4 to 12 inches and a longitudinal (x) height of 2 to 6 inches.

12. The universal seat plate mounting bracket assembly of claim 2 wherein the seat plate has a transverse (z) depth of 1 to 6 inches and a lateral (y) width of 2 to 6 inches.

13. The universal seat plate mounting bracket assembly of claim 2 wherein the seat pad is selected from one of a right seat pad, a left seat pad and a center seat pad wherein (i) the right seat pad has a seat plate that extends a lateral (y) distance of between 2 and 6 inches in a first lateral (y) direction from the knife plate, (ii) the left seat pad has a seat plate that extends a lateral (y) distance of between 2 and 6 inches in a second lateral (y) direction diametrically opposed from the first lateral (y) direction from the knife plate, and (iii) the center seat pad has a seat plate that extends equal lateral (y) distances of at least 1 inch in both the first and second lateral (y) directions from the knife plate.

14. The universal seat plate mounting bracket assembly of claim 3 further comprising (i) a plurality of laterally (y) spaced orifices extending longitudinally (x) through the seat plate, and (ii) a plurality of laterally (y) spaced orifices extending longitudinally (x) through the horizontal leg of the seat clip angle bracket, wherein the orifices through the seat plate and the orifices through the horizontal leg of the seat clip angle bracket are configured and arranged for longitudinal (x) alignment to form through holes for accommodating passage of fasteners therethrough for securing the seat clip angle bracket to the seat plate.

15. The universal seat plate mounting bracket assembly of claim 14 wherein the orifices through one of the seat plate and the horizontal leg of the seat clip angle bracket are transversely (z) elongated slots.

16. The universal seat plate mounting bracket assembly of claim 3 further comprising a plurality of laterally (y) spaced orifices extending transversely (z) through the vertical leg of the seat clip angle bracket for accommodating passage of fasteners therethrough for securing the seat clip angle bracket to a header joist.

17. A kit of components from which various universal seat plate mounting bracket assemblies may be assembled, comprising:

(a) a plurality of mounting brackets, each having (i) a back plate extending within a frontal (x-y) plane and having an upper longitudinal (x) end and a lower longitudinal (x) end, (ii) a knife plate affixed to and extending in a longitudinal (x-z) plane from the back plate in a first transverse (z) direction and having a longitudinal (x) upper edge, and (iii) a bracket tab affixed to and extending in a transverse (y-z) plane from proximate the upper longitudinal (x) end of the back plate in a second transverse (z) direction opposite the first transverse (z) direction and (b) at least one each of a right seat pad, a left seat pad and a center seat pad, wherein:

(i) each seat pad is configured and arranged to be affixed atop the longitudinal (x) upper edge of the knife plate at one of a plurality of selective transverse (z) distances from the back plate, and when secured atop the longitudinal (x) upper edge of the knife plate has a seat plate that extends in a transverse (y-z) plane, (ii) the right seat pad has a seat plate that extends a lateral (y) distance in a first lateral (y) direction from the knife plate when secured atop the longitudinal (x) upper edge of the knife plate, (iii) the left seat pad has a seat plate that extends a lateral (y) distance in a second lateral (y) direction diametrically opposed to the first lateral (y) direction from the knife plate when secured atop the longitudinal (x) upper edge of the knife plate, and (iv) the center seat pad has a seat plate that extends an equal lateral (y) distance of at least 1 inch in both the first and second lateral (y) directions from the knife plate when secured atop the longitudinal (x) upper edge of the knife plate.

18. The kit of claim 17 further comprising a plurality of seat clip angle brackets, each configured and arranged for attachment atop a seat plate with a horizontal leg resting upon the seat plate and a vertical leg extending longitudinally (x) upward from the seat plate.

19. The kit of claim 17, further comprising:

(a) a plurality of orifices extending transversely (z) through the back plate, each configured for accommodating passage of a fastener for securing the universal seat plate mounting bracket to a wall framing member, and (b) a plurality of orifices extending longitudinally (x) through the bracket tab, each configured for accommodating passage of a fastener for securing the universal seat plate mounting bracket to a wall framing member.

20. The kit of claim 18, further comprising (i) a plurality of laterally (y) spaced orifices extending longitudinally (x) through the seat plate, and (ii) a plurality of laterally (y) spaced orifices extending longitudinally (x) through the horizontal leg of the seat clip angle bracket, wherein the orifices through the seat plate and the orifices through the horizontal leg of the seat clip angle bracket are configured and arranged for longitudinal (x) alignment to form through holes for accommodating passage of fasteners therethrough for securing the seat clip angle bracket to the seat plate.

21. The kit of claim 20 wherein the orifices through one of the seat plate and the horizontal leg of the seat clip angle bracket are transversely (z) elongated slots.

22. The kit of claim 17 further comprising a plurality of laterally (y) spaced orifices extending transversely (z) through the vertical leg of the seat clip angle bracket for accommodating passage of fasteners for securing the seat clip angle bracket to a wall framing member.

23. A method of using universal seat plate mounting bracket assemblies according to claim 2 to secure a laterally (y) extending header joist to a vertical structure having a frame formed of wall framing members, comprising the steps of:

(a) fastening a plurality of horizontally aligned mounting brackets to the wall framing members of the vertical structure with the back plates extending vertically and the bracket tabs extending horizontally, (b) positioning the seat plates along the transverse (z) depth of the associated knife plates underneath an anticipated location of the header joist on the vertical structure and securing the seat pads to the associated knife plates at that position, (c) resting the header joist upon the seat plates, and (d) fastening the resting header joist to the vertical structure.

24. A method of using universal seat plate mounting bracket assemblies according to claim 3 to secure a laterally (y) extending header joist to a vertical structure having a frame formed of wall framing members, comprising the steps of:

(a) fastening a plurality of horizontally aligned mounting brackets to the wall framing members of the vertical structure with the back plates extending vertically and the bracket tabs extending horizontally, (b) positioning the seat plates along the transverse (z) depth of associated knife plates underneath an anticipated location of the header joist on the vertical structure and affixing the seat pads to the associated knife plates at that position, (c) resting the header joist upon the seat plates, (d) fastening the resting header joist to the vertical structure, and (e) positioning the seat clip angle brackets into abutting engagement with the header joist, fastening the abutting seat clip angle brackets to associated seat plates, and fastening the seat clip angle brackets to the abutting header joist.

25. A method of using universal seat plate mounting bracket assemblies according to claim 16 to secure a laterally (y) extending header joist to a vertical structure having a frame formed of wall framing members, comprising the steps of:

(a) fastening a plurality of the mounting brackets to the wall framing members of the vertical structure in horizontally aligned fashion to form a horizontal line of mounting brackets, and with the back plates extending vertically and the bracket tabs extending horizontally, wherein a right seat pad is secured to a one of the plurality of mounting brackets at one end of the horizontal line of mounting brackets, a left seat pad is secured to a different one of the plurality of mounting brackets at an other end of the horizontal line of mounting brackets, and a center seat pad is secured to a further different one of the plurality of mounting brackets therebetween, (b) positioning the seat pads to associated knife plates underneath an anticipated location of the header joist on the vertical structure and securing the seat pads to the associated knife plates at that position, (c) resting the header joist upon the seat plates, and (d) fastening the resting header joist to the vertical structure.

* * * * *